US005839125A

United States Patent [19]

Chen

[11] Patent Number: 5,839,125

[45] Date of Patent: Nov. 24, 1998

[54] HAT WITH EXTENSIBLE VISOR

[76] Inventor: Tsao-Hui Chen, 58, Ma Yuan West St., Taichung, Taiwan

[21] Appl. No.: 30,748

[22] Filed: Feb. 25, 1998

[51] Int. Cl.[6] ..... A42B 1/06

[52] U.S. Cl. ..... 2/195.1; 2/10

[58] Field of Search ..... 2/10, 195.1, 12

*Primary Examiner*—Diana L. Biefeld

[57] ABSTRACT

A hat has a main body, a fixed peak disposed on a front portion of the main body, and an extensible visor engaged with the fixed peak. At least an insertion block is disposed on the extensible visor. The insertion block has two opposite lateral teeth. At least a pair of L-shaped racks are disposed on the fixed peak. Each L-shaped rack has a front block and a plurality of serrations. Each lateral teeth engage with the respective serrations.

2 Claims, 5 Drawing Sheets

HAT WITH EXTENSIBLE VISOR

BACKGROUND OF THE INVENTION

The present invention relates to a hat. More particularly, the present invention relates to a hat which has an extensible visor.

A conventional hat does not have an extensible visor. Therefore, the user cannot use an extensible visor to shade the sunlight.

SUMMARY OF THE INVENTION

An object of the present invention is to provide a hat which has an extensible visor to be extended.

Accordingly, a hat comprises a main body, a fixed peak disposed on a front portion of the main body, and an extensible visor engaged with the fixed peak. At least an insertion block is disposed on the extensible visor. The insertion block has two opposite sets of lateral teeth. At least a pair of L-shaped racks are disposed on the fixed peak. Each L-shaped rack has a front block and a plurality of serrations. Each sets of lateral teeth engage with a respective one of the plurality of serrations.

In accordance with a first preferred embodiment of the present invention, a hat comprises a main body, a fixed peak disposed on a front portion of the main body, and an extensible visor engaged with the fixed peak. An insertion block is disposed on the extensible visor. The insertion block has two opposite sets of lateral teeth. A pair of L-shaped racks are disposed on the fixed peak. Each L-shaped rack has a front block and a plurality of serrations. Each set of lateral teeth engage with the respective serrations.

In accordance with a second preferred embodiment of the present invention, a hat comprises a main body, a fixed peak disposed on a front portion of the main body, and an extensible visor engaged with the fixed peak. Two insertion blocks are disposed on the extensible visor. Each insertion block has two opposite set of lateral teeth. Two pairs of L-shaped racks are disposed on the fixed peak. Each L-shaped rack has a front block and a plurality of serrations. Each set of lateral teeth engage with a respective one of the plurality of serrations.

DETAILED DESCRIPTION OF THE INVENTION

Figure 1:
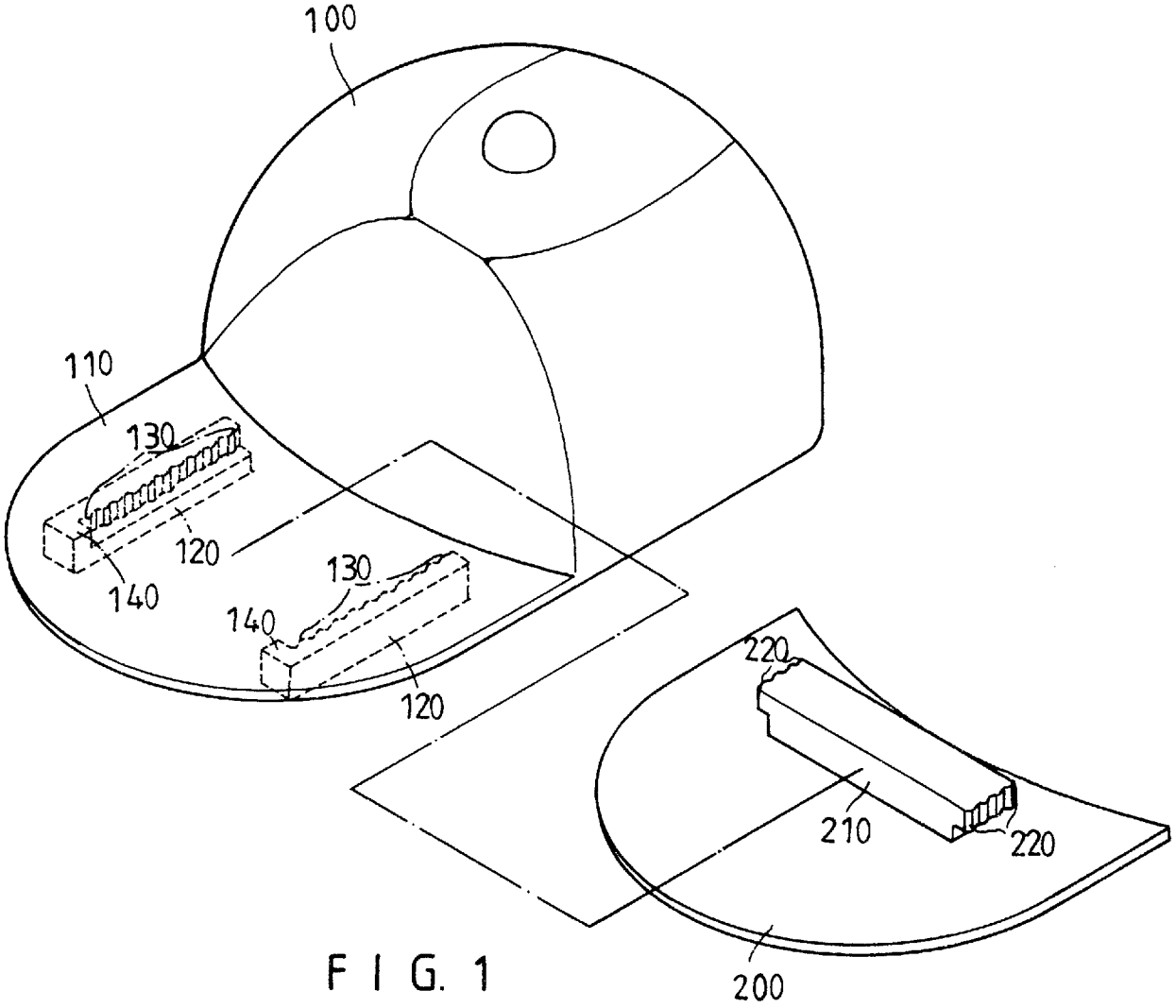
FIG. 1 is a perspective exploded view of a hat of a preferred embodiment in accordance with the present invention.
Figure 2:
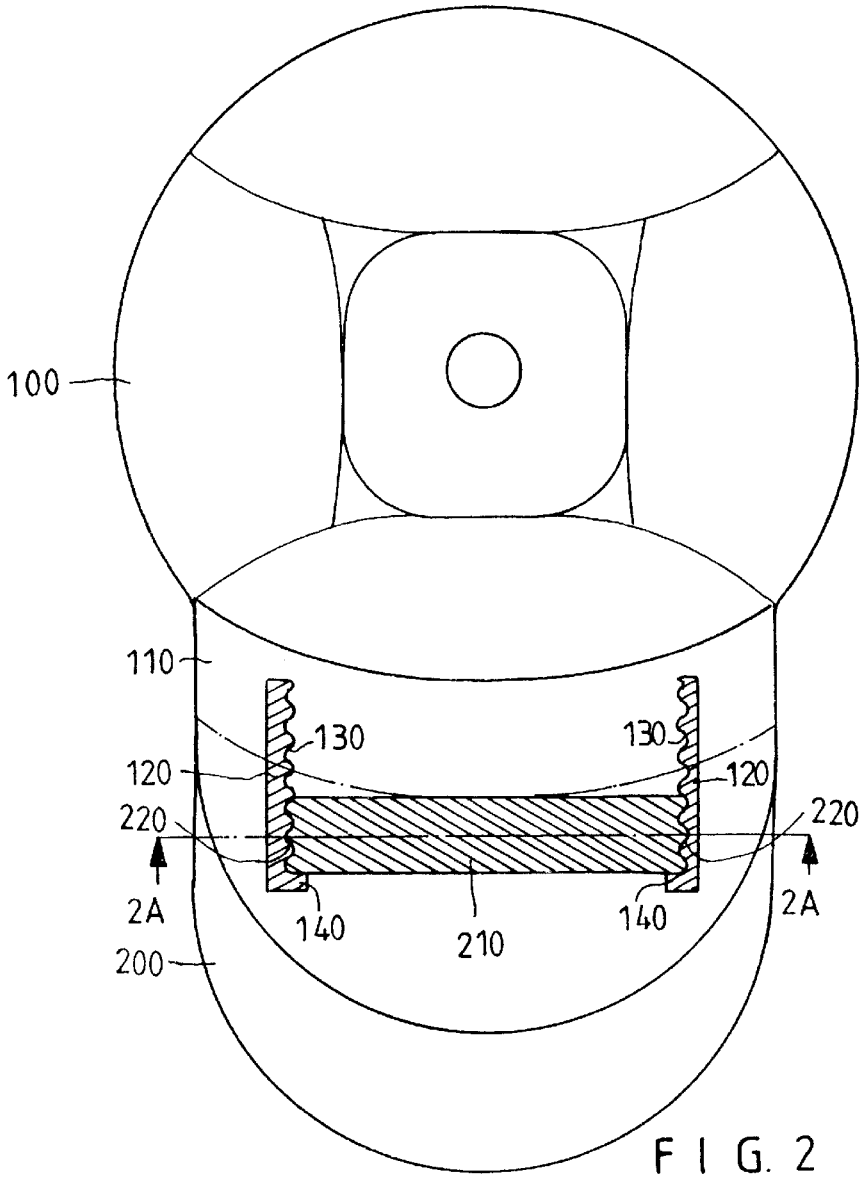
FIG. 2 is a sectional assembly view of a hat of a preferred embodiment in accordance with the present invention.
Figure 2A:
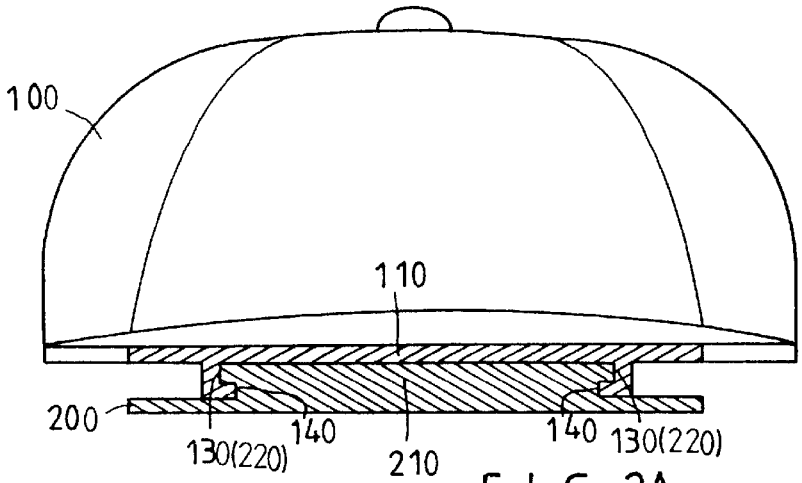
FIG. 2A is a sectional view taken along line 2A—2A in FIG. 2.

Referring to FIGS. 1 to 2A, a first hat comprises a main body 100, a fixed peak 110 disposed on a front portion of the main body 100, and an extensible visor 200 engaged with the fixed peak 110. An insertion block 210 is disposed on the extensible visor 200. The insertion block 210 has two opposite sets of lateral teeth 220. A pair of L-shaped racks 120 are disposed on the fixed peak 110. Each L-shaped rack 120 has a front block 140 and a plurality of serrations 130. Each set of lateral teeth 220 engage with a respective one of the plurality of serrations 130.

Figure 3:
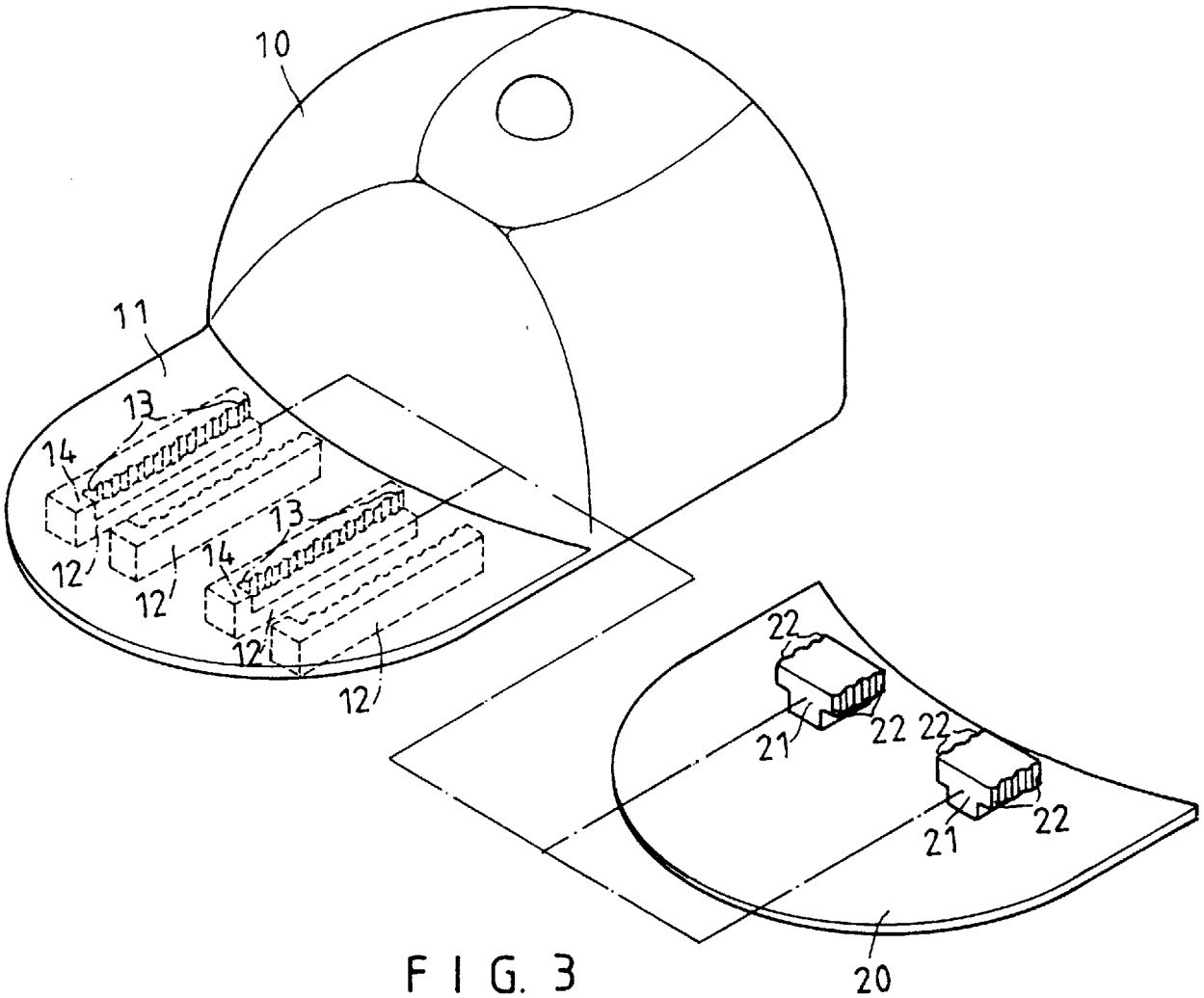
FIG. 3 is a perspective exploded view of a hat of another preferred embodiment in accordance with the present invention.
Figure 4:
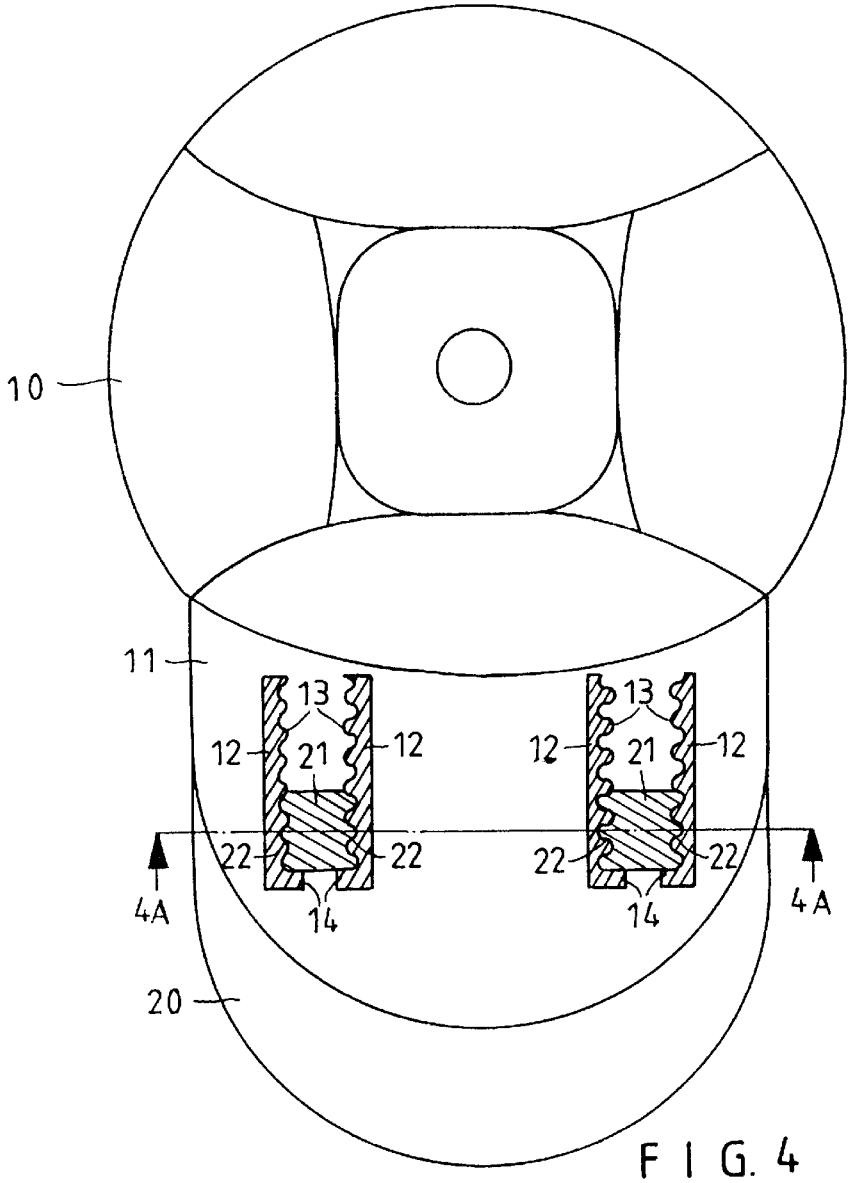
FIG. 4 is a sectional assembly view of a hat of another preferred embodiment in accordance with the present invention.
Figure 4A:
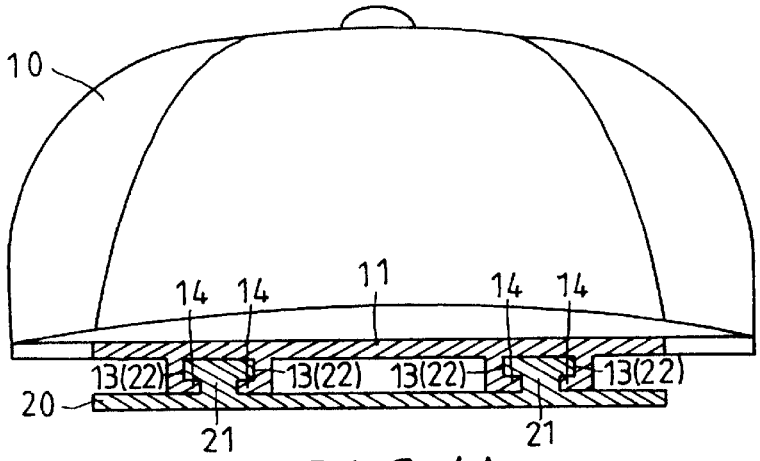
FIG. 4A is a sectional view taken along line 4A—4A in FIG. 4.

Referring to FIGS. 3 to 4A, a second hat comprises a main body 10, a fixed peak 11 disposed on a front portion of the main body 10, and an extensible visor 20 engaged with the fixed peak 11. Two insertion blocks 21 are disposed on the extensible visor 20. Each insertion block 21 has two opposite sets of lateral teeth 22. Two pairs of L-shaped racks 12 are disposed on the fixed peak 11. Each L-shaped rack 12 has a front block 14 and a plurality of serrations 13. Each set of lateral teeth 22 engage with a respective one of the plurality of serrations 13.

Figure 5:
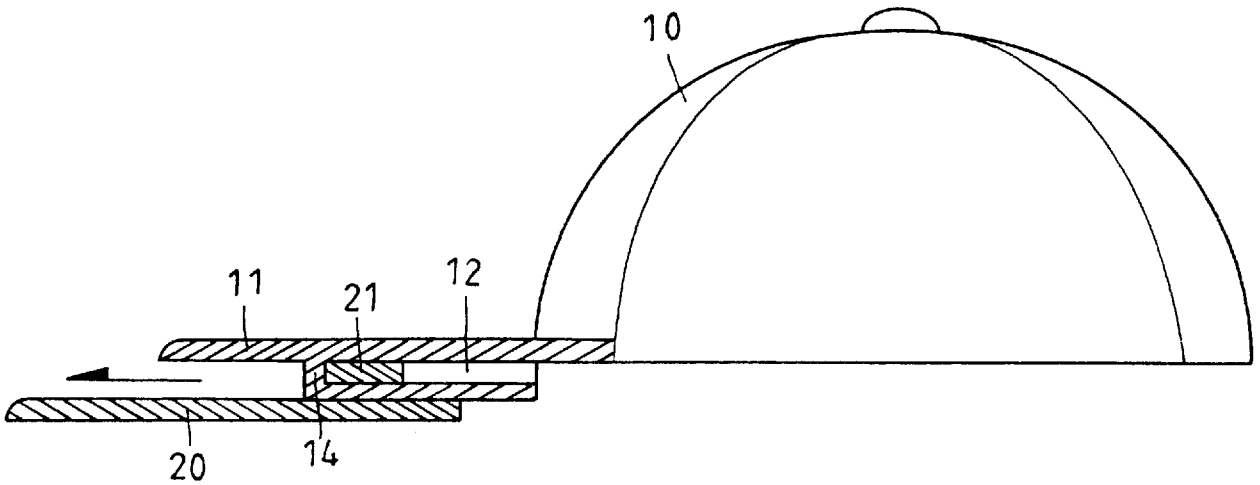
FIG. 5 is a schematic view illustrating an application of a hat of another preferred embodiment in accordance with the present invention.

Referring to FIG. 5, the extensible visor 20 can be extended. Each insertion block 21 moves along a respective one of the plurality of serrations 13.

The present invention is not limited to the above embodiments but various modification thereof may be made. Furthermore, various changes in form and detail may be made without departing from the scope of the present invention.

I claim:

1. A hat comprising:

a main body, a fixed peak disposed on a front portion of the main body, and an extensible visor engaged with the fixed peak, at least an insertion block disposed on the extensible visor, the insertion block having two opposite sets of lateral teeth, at least a pair of L-shaped racks disposed on the fixed peak, each said L-shaped rack having a front block and a plurality of serrations, and each set of lateral teeth engaging with a respective one of said plurality of serrations.

2. A hat comprising:

a main body, a fixed peak disposed on a front portion of the main body, and an extensible visor engaged with the fixed peak, two insertion blocks disposed on the extensible visor, each said insertion block having two opposite sets of lateral teeth, two pairs of L-shaped racks disposed on the fixed peak, each said L-shaped rack having a front block and a plurality of serrations, and each said set of lateral teeth engaging with a respective one of said plurality of serrations.

* * * * *